US008746420B2

(12) United States Patent
Costaz

(10) Patent No.: US 8,746,420 B2
(45) Date of Patent: Jun. 10, 2014

(54) CUT-IN-CUT-OUT VALVES FOR HYDRAULIC CIRCUITS

(75) Inventor: Dominique P Costaz, Verberie (FR)

(73) Assignee: Poclain Hydraulics Industrie, Verberie (FR)

( * ) Notice: Subject to any disclaimer, the term of this patent is extended or adjusted under 35 U.S.C. 154(b) by 204 days.

(21) Appl. No.: 13/230,781

(22) Filed: Sep. 12, 2011

(65) Prior Publication Data

US 2012/0060942 A1 Mar. 15, 2012

(30) Foreign Application Priority Data

Sep. 13, 2010 (FR) ..... 10 57270

(51) Int. Cl.
*F16D 65/22* (2006.01)

(52) U.S. Cl.
USPC ..... 188/170; 188/156; 188/157; 188/162; 188/182; 60/413; 60/445; 60/450; 60/452; 180/442; 137/565.19

(58) Field of Classification Search
USPC ..... 188/170, 175, 182, 162, 156, 157; 60/413, 445, 450, 452; 137/511, 137/565.19; 280/124.159, 124.16, 124.157; 303/10, 11, 59
See application file for complete search history.

(56) References Cited

U.S. PATENT DOCUMENTS

| | | | | |
|---|---|---|---|---|
| 6,321,534 | B1 | 11/2001 | A'Hearn et al. | |
| 6,938,413 | B2 * | 9/2005 | Harnischfeger | 60/413 |
| 7,726,125 | B2 * | 6/2010 | Brinkman et al. | 60/452 |
| 7,866,150 | B2 * | 1/2011 | Harber et al. | 60/413 |
| 2010/0154403 | A1 * | 6/2010 | Brickner et al. | 60/452 |

FOREIGN PATENT DOCUMENTS

| | | |
|---|---|---|
| DE | 3426354 | 1/1986 |
| WO | WO 03/006753 | 1/2003 |

* cited by examiner

*Primary Examiner* — Robert A Siconolfi
*Assistant Examiner* — San Aung
(74) *Attorney, Agent, or Firm* — Blakely Sokoloff Taylor & Zafman

(57) ABSTRACT

Cut-in-cut-out valves for hydraulic circuits. The hydraulic circuits include a hydraulic pump outputting a variable pressure controlled by a slaving line, an accumulation circuit, a return line to the reservoir, a cut in-cut-out valve. The hydraulic circuits also include a cut-in-cut-out valve having four orifices, a first orifice connected to the supply line, a second orifice connected to the slaving line, a third orifice connected to the return line leading to the reservoir, and a fourth orifice connected to the accumulation circuit. The cut-in-cut-out valve alternates between two positions as a function of the pressure in the accumulation circuit, a cut-in position in which the first, second and fourth orifices are connected to each other, and a cut-out position in which the first and fourth orifices are closed.

7 Claims, 5 Drawing Sheets

CUT-IN-CUT-OUT VALVES FOR HYDRAULIC CIRCUITS

GENERAL TECHNICAL FIELD

This invention relates to the technical field of cut-in-cut-out valves for hydraulic circuits, and hydraulic circuits equipped with such cut-in-cut-out valves, for example open loop hydraulic circuits.

STATE OF THE ART

Cut-in-cut-out valves are components of hydraulic circuits that will be used with an accumulator.

For example, such components are used for hydraulic braking circuits, associated with hydraulic pumps slaved to the load, commonly called "load sensing pumps".

Hydraulic pumps slaved to the load are well known to those skilled in the art; they are variable capacity pumps, the capacity of which is controlled by a pressure slaving line. In this way, these pumps output the flow necessary to the connected devices, at a pressure slightly greater than the force to be provided.

These pumps are connected to two types of consuming devices:

- devices of a first type that require a relatively constant supply pressure, and
- devices of a second type that require a supply pressure varying as a function of the force to be supplied.

An example of devices of the first type is a brake control.

Examples of devices of the second type include lifting jacks and motors.

It is understood that the capacity of the pump and the pressure set up at its discharge orifice will vary as a function of use, while circuits of the first type such as brake circuits require a supply pressure that is constant or at least remains within a given range of values, otherwise the user will receive a variable response which is undesirable.

Therefore, the first type of auxiliary devices are supplied through accumulators that are themselves supplied through a pump slaved to the load, and more commonly called a "load sensing pump".

A cut-in-cut-out valve forms the connection between the pump and the accumulators, so that when it is in the cut-in position the accumulators can be filled if they are not sufficiently full, and when it is in the cut-out position it stops the accumulators from being filled.

Figure 1:
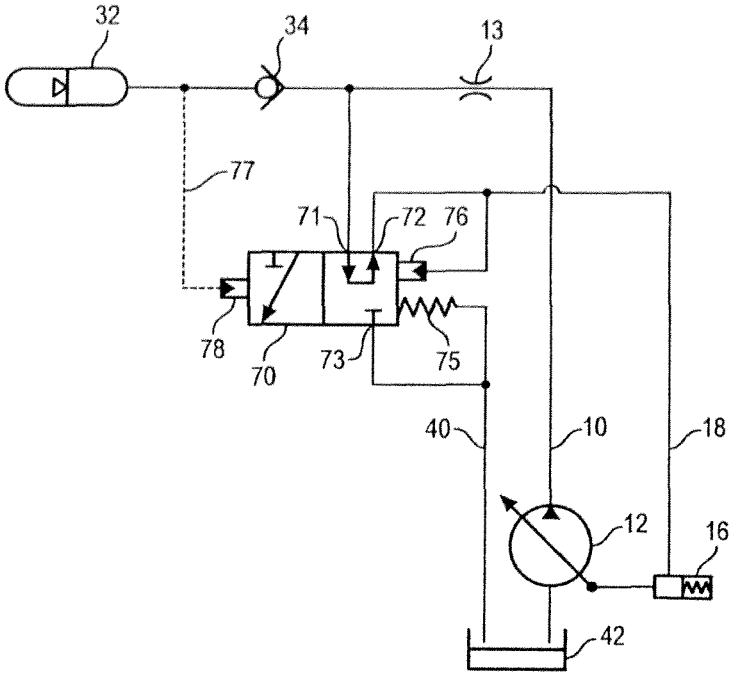
FIG. 1 (PRIOR ART)

FIG. 1 shows a diagram of the principle of such a circuit.

This hydraulic circuit 1 comprises:

- a hydraulic pump 12 slaved to the load, connected to a supply line 10,
- a slaving line 18 connected to a control 16 of the pump 12,
- an accumulator 32 connected to the pump 12 through the supply line 10,
- a return line to the reservoir 40 leading to a zero pressure reservoir 42, also called an atmospheric pressure reservoir, and
- a cut-in-cut-out valve 70.

The accumulator 32 as shown diagrammatically in FIG. 1 is a gas accumulator; this representation is not limitative, any other appropriate type of accumulator could be used.

The following figures also show the different accumulators using the normalised representation of a gas accumulator, but it can easily be understood that this representation is not limitative and that any other types of accumulators could be used.

The cut-in-cut-out valve 70 can alternate between a cut-in position and a cut-out position, and has three orifices 71, 72 and 73.

The first orifice 71 of the cut-in-cut-out valve 70 is connected to the supply line 10, the second orifice 72 is connected to the slaving line 18 of the hydraulic pump 12, and its third orifice 73 is connected to the return line leading to the reservoir 40.

The supply line 10 is provided with a non-return valve 34 placed so as to prevent circulation of the hydraulic fluid from the accumulator 32 to the supply line 10, and a flow limiter 13 that for example may be in the form of sprinklers so as to limit the flow in the supply line 10.

In the cut-in position, the first orifice 71 is connected to the second orifice 72 while the third orifice is closed off.

In this position, the pump 12 supplies and fills the accumulator 32, and the cut-in-cut-out valve 70 supplies pressure to the slaving line 18 and the control 16 of the pump 12, which therefore outputs an appropriate pressure for filling the accumulator 32.

In the cut-out position, the first orifice 71 is closed while the second orifice 72 is connected to the third orifice 73.

In this position, the slaving line 18 of the pump 12 is connected to the fluid reservoir at atmospheric pressure, and the fluid reservoir is therefore at atmospheric pressure. This atmospheric pressure in the slaving line 18 results in a relatively low pressure at the output from pump 12, which then does not cause any increase in pressure in the accumulator 32.

The set pressure output by the pump 12 is then minimum, and it is a minimum calibrated waiting pressure of the order of 10 to 20 bars.

The pump 12 will not need to output any flow to any consuming device, and it will move into a very low capacity position to compensate for residual leaks from the hydraulic circuit 1.

The cut-in-cut-out valve 70 is in its cut-in position by default, under the effect of an elastic actuator 75 such as a spring connected to the return line leading to the reservoir 40, and typically coupled with an activator 76 connected to the slaving line 18.

The cut-in-cut-out valve 70 alternates between its cut-in position and its cut-out position when the pressure in the accumulator 32 reaches a high threshold value called the cut-out pressure. The cut-in-cut-out valve 70 then moves from its cut-in position to its cut-out position, the cut-out pressure being transferred through a cut-out control line 77 to a cut-out actuator 78.

The changeover from the cut-out position to the cut-in position is made when the pressure in the accumulator 32 reaches a second low threshold value called the cut-in pressure, which is typically less than the cut-out pressure.

Depending on the particular applications, the cut-in pressure is of the order of 110 or 90 bars and the associated cut-out pressure is of the order of 130 or 120 bars respectively.

A hydraulic circuit as shown in FIG. 1 may be used in several domains, including the farm machine field and construction site machinery domains.

Figure 2:
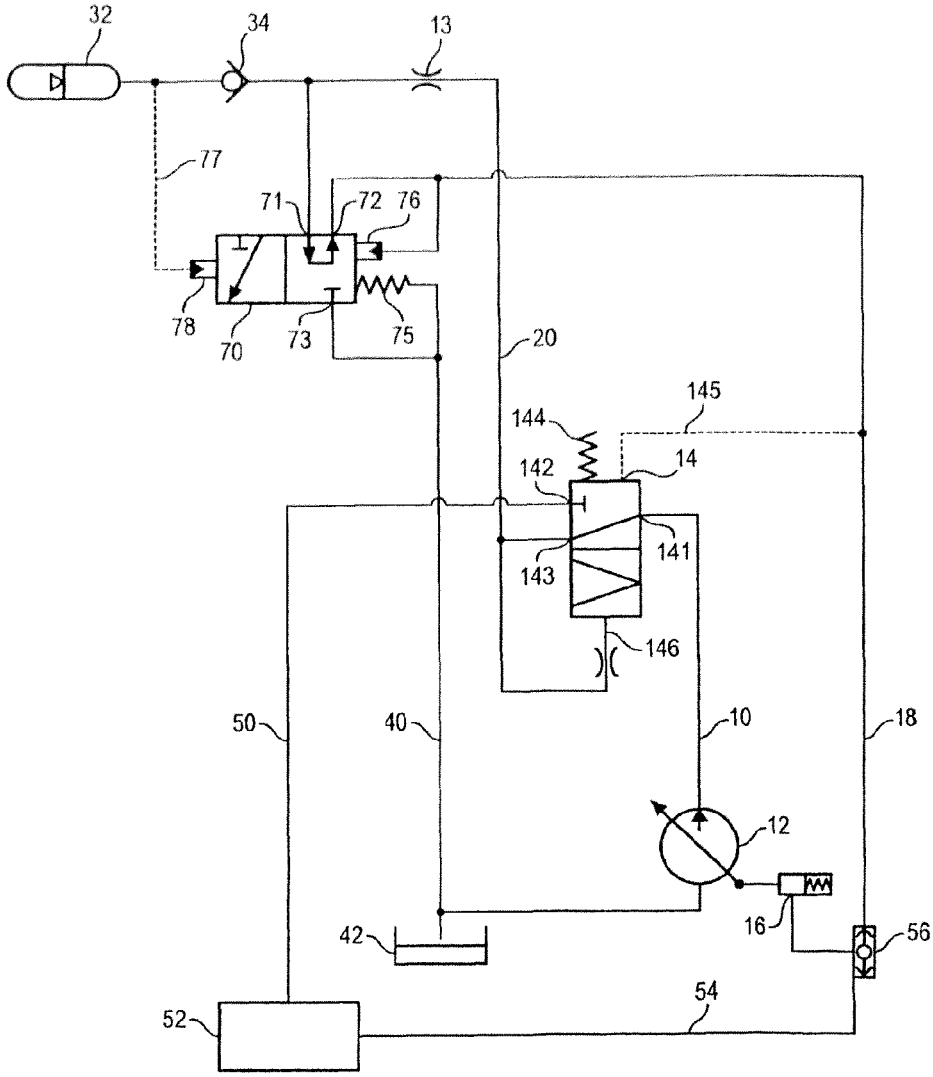
FIG. 2 (PRIOR ART)

FIG. 2 shows an example application of such a circuit.

Elements common with FIG. 1 are identified by the same numeric references; the following description only applies to elements that are different in them.

The circuit as shown in FIG. 2 comprises a priority slide 14 connected to the pump 12 through the supply line 10, this priority slide 14 comprising three orifices 141, 142 and 143.

The first orifice 141 is connected to the pump 12 through the supply line 10.

The second orifice 142 is connected to the accumulator 32 and to the cut-in-cut-out valve 70 through a load line 20, and the third orifice 143 is connected to an auxiliary device 52 through an output line 50.

The priority slide 14 may be in one of the two positions:

a filling position in which its first orifice 141 is connected only to its third orifice 143 so as to fill the accumulator 32, a supply position, in which its first orifice 141 is connected both to the second orifice 142 and to the third orifice 143, so as to supply the accumulator 32 and the auxiliary 52 with hydraulic fluid at the same time.

In its default configuration, the priority slide 14 is in its filling position under the effect of an elastic actuator 144 such as a spring, installed in parallel with an actuator 145 connected to the slaving line 18.

The changeover from the filling position to the supply position takes place under the action of a priority actuator 146 placed facing the elastic actuator 144 and the actuator 145 connected to the slaving line 18, these actuators 144, 145 and 146 being configured such that the changeover from the filling position to the supply position takes place when the pressure in the load line 20 reaches a given value, when the pressure at the actuator 146 is greater than the pressure at the actuator 145 plus the setting of the elastic actuator 144; namely typically a pressure of the order of 18 bars.

Several types of auxiliary devices can be used, for example hydraulic actuators.

This auxiliary device 52 is connected through an auxiliary load line 54 to the slaving line 18 of the pump 12, this auxiliary load line 54 being provided with a shuttle valve 56, such that only the line with the highest pressure between the slaving line 18 and the auxiliary load line 54 is connected to the control 16 of the pump 12.

Thus, the pressure output by the pump 12 is controlled both by the slaving line 18 and by the auxiliary load line 54.

However, such a hydraulic circuit can result in an excessive pressure build up in the accumulator 32. Slaving of the pressure output by the pump 12 to the auxiliary device 52 through the auxiliary load line 54 can lead to a pressure in the supply line 10 being greater than the cut-out pressure of the cut-in-cut-out valve 70, which can cause an over pressure in the accumulator and thus cause damage to it, so that the cut-in-cut-out valve does not function correctly.

This invention discloses a solution to this problem and avoids the risk of overpressure in the accumulator.

PRESENTATION OF THE INVENTION

This invention relates to a hydraulic circuit comprising:

a hydraulic pump outputting a variable pressure, said hydraulic pump supplying a supply line and being controlled by a slaving line, an accumulation circuit comprising at least one accumulator, a return line to the reservoir connected to an atmospheric pressure reservoir, a cut-in-cut-out valve, said hydraulic circuit being characterised in that the cut-in-cut-out valve comprises four orifices:

a first orifice connected to the supply line, a second orifice connected to the slaving line, a third orifice connected to the return line leading to the reservoir, a fourth orifice connected to the accumulation circuit, said cut-in-cut-out valve having two positions:

a cut-in position in which the first, second and fourth orifices are connected to each other, while the third orifice is closed, a cut-out position in which the first and fourth orifices are closed, while the second orifice is connected to the third orifice, so as to isolate the accumulation circuit from the supply line;

said cut-in-cut-out valve being adapted to change from the cut-in position to the cut-out position when the pressure in the accumulation circuit reaches a threshold value.

According to one particular embodiment, the hydraulic circuit also comprises a priority slide with three orifices:

a first orifice connected to the pump through the supply line, a second orifice connected to an output line, a third orifice connected to a load line, itself connected Co the first orifice of the cut-in-cut-out valve, the priority slide having two positions;

a filling position in which its first orifice is connected only to its third orifice, a supply position, in which its first orifice is connected to both the second and third orifices, the output line being connected to at least one auxiliary device with an auxiliary load line connected to the slaving line.

According to another variant, the circuit also comprises a non-return valve placed on its accumulation circuit so that the hydraulic fluid can only circulate from the first orifice of the cut-in-cut-out valve to the accumulation circuit.

According to another variant, the circuit comprises a circuit breaking distributor, said circuit breaking distributor comprising three orifices:

a first orifice connected to the second orifice of the cut-in-cut-out valve, a second orifice connected to the slaving line, a third orifice connected to the reservoir return line said circuit breaking distributor being provided with two positions:

a closed position in which the first orifice is connected to the second orifice, while the third orifice is closed, an open position in which the second orifice is connected to the third orifice, while the first orifice is closed, According to another variant, the slaving line is connected to an auxiliary load line of an auxiliary device through a selector.

According to another variant, the accumulation circuit comprises at least one assembly comprising an accumulator associated with a brake valve with positive or negative braking.

According to one particular embodiment of this variant, the circuit comprises two assemblies comprising an accumulator associated with a brake valve with positive or negative braking, mounted in parallel and connected to the fourth orifice of the cut-in-cut-out valve through a selection valve.

PRESENTATION OF THE DRAWINGS

Figure 3:
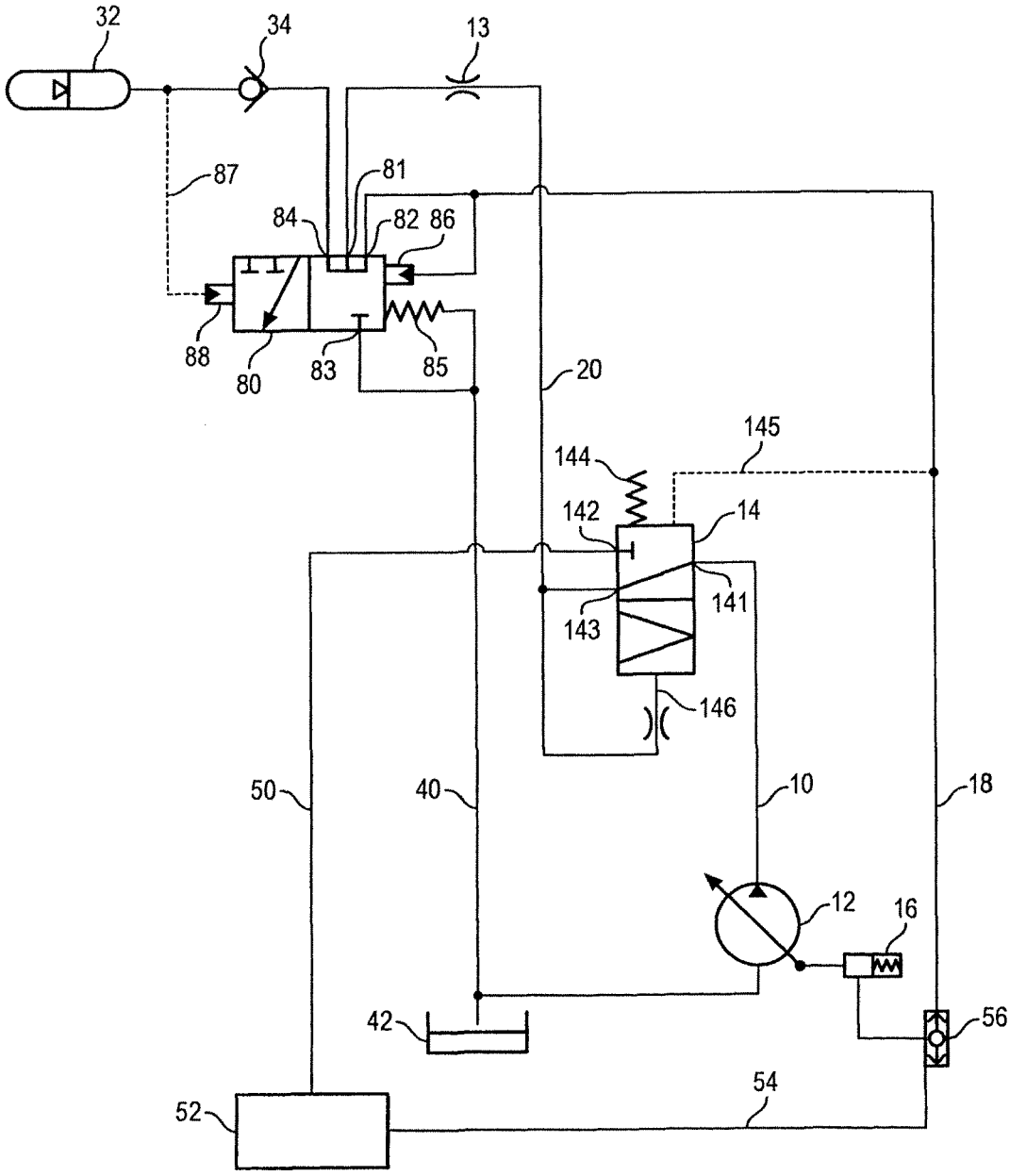
Figure 4:
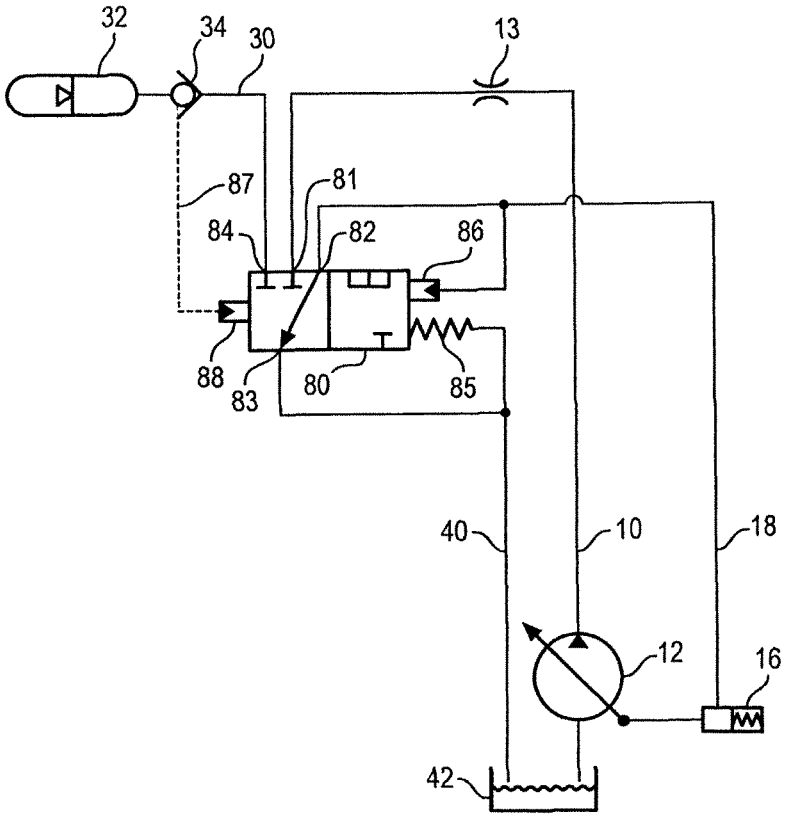
Figure 5:
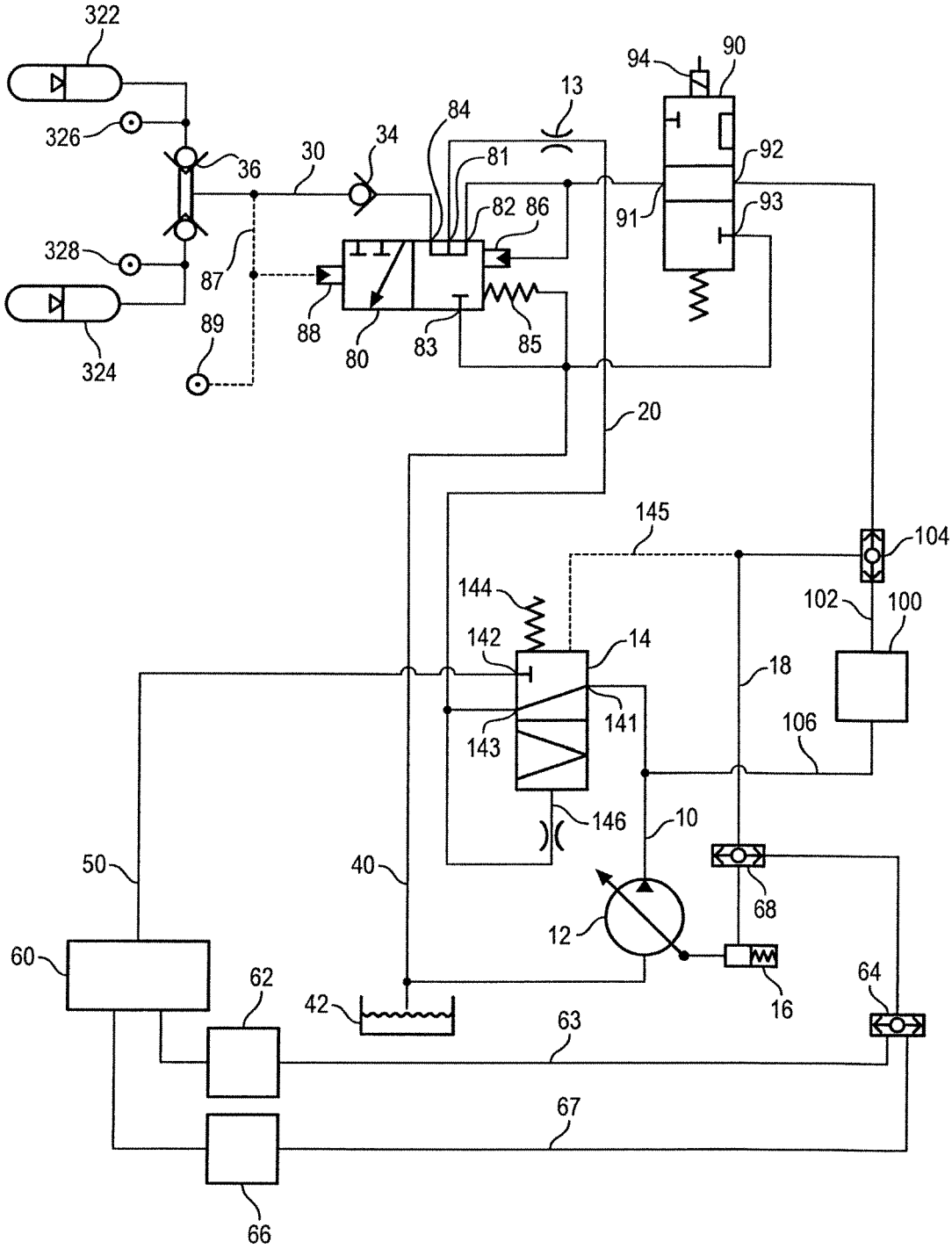

Other characteristics, purposes and advantages of the invention will become clear after reading the following description which is given purely for illustrative and non-limitative purposes, and that must be read with reference to the appended drawings in which:

FIGS. 1 and 2 previously described show a hydraulic circuit comprising a cut-in-cut-out valve according to the state of the art, and an example application of such a circuit, respectively, FIG. 3 shows an improvement to the hydraulic circuit shown in FIG. 2, equipped with a cut-in-cut-out valve according to the invention, FIG. 4 shows a simplified hydraulic circuit comprising a cut-in-cut-out valve according to the invention, shown in the cut-out position, FIG. 5 shows a particular embodiment of the hydraulic circuit according to the invention.

DETAILED DESCRIPTION

FIG. 3 shows a hydraulic circuit similar to the hydraulic circuit shown in FIG. 2, but with a cut-in-cut-out valve 80 according to the invention.

Elements similar to those presented in FIG. 2 are identified by identical numeric references; the following description only refers to the differences from the hydraulic circuit shown in FIG. 2.

The cut-in-cut-out valve 80 can alternate between a cut-in position and a cut-out position, and comprises four orifices 81, 82, 83 and 84.

The first orifice 81 of the cut-in-cut-out valve 88 is connected to the load line 20, its second orifice 82 is connected to the slaving line 18 of the hydraulic pump 12, its third orifice 83 is connected to the return line leading to the reservoir 40 and its fourth orifice 84 is connected to the accumulator 32 through an accumulation line 30.

When the cut-in-cut-out valve 80 is in the cut-in position, this fourth orifice 84 is connected to the first orifice 81 and to the second orifice 82. Thus, the hydraulic fluid transferred to the cut-in-cut-out valve through the load line 20 is distributed in both the accumulation line 30 and in the slaving line 18. The third orifice 83 connected to the zero pressure reservoir 42 is closed off.

When the cut-in-cut-out valve 80 is in the cut-out position, the first orifice 81 and the fourth orifice 84 are closed off. The slaving line 18 is connected to the zero pressure reservoir 42 when the cut-in-cut-out valve 80 is in the cut-out position.

In the same way as for the cut-in-cut-out valve 70 shown in FIGS. 1 and 2, the cut-in-cut-out valve 80 according to the invention is kept by default in the cut-in position under the action of an elastic actuator 85 such as a spring, typically coupled with an actuator 86 connected to the return line leading to the reservoir 40.

The accumulation line 30 is connected to a cut-out control line 87 that leads to a cut-out actuator 88 changing the cut-in-cut-out valve 80 from its cut-in position to its cut-out position.

Unlike the circuit shown in FIG. 2, the load line 20 is not directly connected to the accumulator 32, but only to the first orifice 81 of the cut-in-cut-out valve 80.

The accumulator 32 is connected to the fourth orifice 84 of the cut-in-cut-out valve 80 through an accumulation line 30.

Thus, when the cut-in-cut-out valve 80 is in the cut-out position, there is no possible hydraulic fluid circulation from the load line 20 to the accumulation line 30.

Thus, even if the pressure at the output from the pump 12 is high due to the action of the auxiliary device 52 on the control 16 of the pump 12, the accumulator 32 remains isolated from the load line 20 when the cut-in-cut-out valve is in the cut-out position, and therefore the accumulator 32 cannot be subject to excessive pressure.

FIG. 4 shows a principle diagram similar to that shown in FIG. 1, but it comprises a cut-in-cut-out valve 80 like that shown in FIG. 3.

This hydraulic circuit is limited to a small number of components and does not include any auxiliary device that could cause an excessive pressure increase in the accumulator 32, but it clearly shows the separation between the accumulator 32 and the pump 12.

In this case, the cut-in-cut-out valve 80 is shown in the cut-out position, and therefore the pressure in the accumulator 32 cannot be increased.

FIG. 5 shows a diagram of a hydraulic system with elements common to those shown in FIG. 3, but with additional elements.

Elements similar to those shown in FIG. 3 are identified by identical numeric references; the differences between this hydraulic circuit and the circuit shown in FIG. 3 are described below.

In this hydraulic system, the accumulator 32 is replaced by assemblies 322 and 324, each comprising at least one accumulator associated with at least one braking valve, and pressure connectors 326 and 328.

More generally, the accumulator 32 as shown in the previous figures is replaced by an accumulation circuit comprising at least one accumulator.

Depending on the particular embodiments, the assemblies 322 and 324 may for example comprise the following respectively:

- an accumulator associated with a release pressure brake valve, or a brake with negative braking, for example a car parking brake,
- an accumulator associated with a brake valve with positive braking.

As shown in FIG. 5, the assemblies 322 and 324 and the pressure connectors 326 and 328 are arranged in two groups:

- a first group comprising the assembly 322 and the pressure connector 326, and
- a second group comprising the assembly 324 and the pressure connector 328.

These two groups are connected to the accumulation line 30 through a selection valve 36, also called a shuttle valve, this selection valve 36 being used only to transfer hydraulic fluid from the accumulation line 30 to either group 322 and 326 or group 324 and 328, whichever has the lowest pressure. In practice, the selection valve 36 is designed so that the cut-in-cut-out is effective only on the first of the groups 322 and 326 or 324 and 328 that drops below the cut-in pressure.

The cut-out control line 87 is also connected to a pressure connector 89, so that the pressure in this line 87 can be controlled.

The output line 50 is now connected to an output distributor 60 leading to different auxiliary devices 62 and 66, typically actuators, these auxiliary devices 62 and 66 being connected to the slaving line 18 through pressure-sensitive lines 63 and 67 respectively, each of said lines 63 and 67 being connected by a selection valve 64 also called a shuttle valve, itself connected by a selection valve 68 (or shuttle valve) to the slaving line 18. Thus, the control 16 of the pump 12 is only controlled by the pressure-sensitive line with the highest pressure among lines 63, 67 and 18.

The circuit as shown in FIG. 5 also comprises a circuit breaking distributor 90 that can alternate between two positions. This circuit breaking distributor 90 comprises a first orifice 91 connected to the second orifice 82 of the cut-in-cut-out valve 80 and second and third orifices 92 and 93 respectively connected to the slaving line 18 and the return line to the reservoir 40.

In its first position called the closed position, the first orifice 91 is connected to the second orifice 92 while the third orifice 93 is closed, so that the second orifice 82 of the cut-in-cut-out valve 80 can be connected to the control 16 of the pump 12.

In its second position called the open position, the first orifice 91 is closed while the second orifice 92 is connected to the third orifice 93. Therefore, the slaving line 18 is connected to the zero pressure reservoir 42.

This circuit breaking distributor 90 is in the closed position by default, and it is controlled by a control means 94 such as a solenoid valve so as to move into the open position. It thus isolates the second orifice 82 of the cut-in-cut-out valve 80 so that it will not move into the cut-in position and increase the load on the pump 12 at moments at which it is not required.

One non-limitative example is the start up of a thermal combustion engine by an electric motor, in which case the circuit breaking distributor 90 will typically be in the open position to avoid increasing the load on the electric motor.

As illustrated, the hydraulic circuit also comprises an auxiliary braking device 100 supplied by the hydraulic pump 12 directly through a direct supply line 106 and therefore in priority relative to other auxiliary devices. This auxiliary braking device 100 comprises a pressure regulation device not shown in the figures, and it is connected to the slaving line 18 by an auxiliary load line 102 from the auxiliary braking device 100 external to this hydraulic circuit, except for this connection.

For example, such an external auxiliary device 100 could be a trailer brake, while the hydraulic circuit as shown is the braking circuit of a farm machine or a construction site machine to which this trailer is hitched.

The slaving line 18 is connected through a circuit selector 104 firstly to the pressure-sensitive line or the auxiliary load line 102 of the external auxiliary device 100, and secondly to the second orifice 92 of the circuit breaking distributor 90, the circuit selector 104 making it possible to connect the slaving line 18 only to the auxiliary load line 102 or the second orifice 92 of the circuit breaking distributor 90, whichever is at the highest pressure.

The invention claimed is:

1. Hydraulic circuit comprising:

a hydraulic pump outputting a variable pressure, said hydraulic pump supplying a supply line and being controlled by a slaving line, an accumulation circuit comprising at least one accumulator, a return line to the reservoir connected to an atmospheric pressure reservoir, a cut-in-cut-out valve, wherein the cut-in-cut-out valve comprises four orifices:

a first orifice connected to the supply line, a second orifice connected to the slaving line, a third orifice connected to the return line leading to the reservoir, a fourth orifice connected to the accumulation circuit, said cut-in-cut-out valve having two positions:

a cut-in position in which the first, second and fourth orifices are connected to each other, while the third orifice is closed, a cut-out position in which the first and fourth orifices are closed, while the second orifice is connected to the third orifice, so as to isolate the accumulation circuit from the supply line;

said cut-in-cut-out valve being adapted to change from the cut-in position to the cut-out position when the pressure in the accumulation circuit reaches a threshold value.

2. Hydraulic circuit according to previous claim 1, also comprising a priority slide comprising three orifices:

a priority slide first orifice connected to the pump through the supply line, a priority slide second orifice connected to an output line, a priority slide third orifice connected to a load line, itself connected to the first orifice of the cut-in-cut-out valve, the priority slide having two positions;

a filling position in which the first priority slide orifice is connected only to the third priority slide orifice, a supply position, in which the first priority slide orifice is connected to both the second and third priority slide orifices, the output line being connected to at least one auxiliary device with an auxiliary load line connected to the slaving line.

3. Hydraulic circuit according to claim 1, also comprising a non-return valve placed on the accumulation circuit so that the hydraulic fluid can only circulate from the first orifice of the cut-in-cut-out valve to the accumulation circuit.

4. Hydraulic circuit according to claim 1, comprising a circuit breaking distributor (90), said circuit breaking distributor comprising three orifices:

a circuit breaking distributor first orifice connected to the second orifice of the cut-in-cut-out valve, a circuit breaking second orifice connected to the slaving line, a circuit breaking distributor third orifice connected to the reservoir return line, said circuit breaking distributor being provided with two positions:

a closed position in which the first circuit breaking distributor orifice is connected to the second circuit breaking distributor orifice, while the third circuit breaking distributor orifice is closed, an open position in which the second circuit breaking distributor orifice is connected to the third circuit breaking distributor orifice, while the first circuit breaking distributor orifice is closed.

5. Hydraulic circuit according to claim 1, in which the slaving line is connected to an auxiliary load line of an auxiliary device through a selector.

6. Hydraulic circuit according to claim 1, in which the accumulation circuit comprises at least one assembly comprising an accumulator associated with a brake valve with positive or negative braking.

7. Hydraulic circuit according to claim 1, comprising two assemblies comprising an accumulator associated with a brake valve with positive or negative braking, mounted in parallel and connected to the fourth orifice of the cut-in-cut-out valve through a selection valve.

* * * * *

UNITED STATES PATENT AND TRADEMARK OFFICE

CERTIFICATE OF CORRECTION

PATENT NO. : 8,746,420 B2
APPLICATION NO. : 13/230781
DATED : June 10, 2014
INVENTOR(S) : Costaz It is certified that error appears in the above-identified patent and that said Letters Patent is hereby corrected as shown below:

In the Claims,

Column 8, Claim 4, line 31, please delete "breaking second" and insert --breaking distributor second--.

Signed and Sealed this
Sixteenth Day of December, 2014

Michelle K. Lee

Michelle K. Lee
*Deputy Director of the United States Patent and Trademark Office*